United States Patent [19]

Sapp

[11] 4,387,628

[45] Jun. 14, 1983

[54] CHIMNEY SEAL

[75] Inventor: Dennis H. Sapp, Terre Haute, Ind.

[73] Assignee: Research-Cottrell, Inc., Somerville, N.J.

[21] Appl. No.: 196,112

[22] Filed: Oct. 10, 1980

[51] Int. Cl.[3] ..... F23J 11/00

[52] U.S. Cl. ..... 98/58; 110/184

[58] Field of Search ..... 98/58, 60; 110/184

[56] References Cited

U.S. PATENT DOCUMENTS

| | | | |
|---|---|---|---|
| 3,631,789 | 1/1972 | Kilvey | 98/58 |
| 3,669,042 | 6/1972 | Lawrence | 98/60 X. |
| 3,752,091 | 8/1973 | Lawrence | 110/184 |
| 3,822,636 | 7/1974 | Chadwick | 98/60 |
| 4,111,107 | 9/1978 | Engleke | 98/60 |
| 4,191,099 | 3/1980 | Strahl | 98/60 |

FOREIGN PATENT DOCUMENTS

| | | | |
|---|---|---|---|
| 45-40980 | 12/1970 | Japan | 98/58 |

*Primary Examiner*—Albert J. Makay

*Assistant Examiner*—Harold Joyce

*Attorney, Agent, or Firm*—Wood, Dalton, Phillips, Mason & Rowe

[57] ABSTRACT

A chimney having a tubular inner liner and a tubular outer wall is provided with a seal for sealingly closing the upper end of the space between the liner and outer wall notwithstanding the radial and longitudinal displacement between the liner and outer wall. The seal includes a plurality of slidingly engageable seal elements which permit such relative movement between the liner and outer wall while maintaining an effective seal therebetween at all times. One of the seal elements may be fixedly mounted to one of the liner or outer wall and the other of the seal elements may be movably associated with the other of the liner and outer wall. An annular rain hood is provided above the seal in the illustrated embodiment. In one form, the seal is disposed in overlying relationship to the space between the liner and outer wall and in another embodiment, the seal is disposed radially outwardly thereof.

15 Claims, 6 Drawing Figures

CHIMNEY SEAL

BACKGROUND OF THE INVENTION

1. Field of the Invention

This invention relates to the sealing of chimneys having concentric walls defining a tubular pressurized air space therebetween.

2. Description of the Background Art

In one form of chimney such as used in industrial applications, the chimney includes a tubular inner liner and a tubular outer wall spaced radially concentrically from the liner to define a space therebetween. Pressurized air or similar fluid is provided in the space to prevent ingress of products of combustion from the interior of the liner into this space so as to prevent such products of combustion from adversely acting on the outer wall, which is conventionally formed of concrete.

A number of seals have been developed for sealing the upper end of the space between the liner and outer wall. A serious problem arises in the construction of such seals in that substantial relative movement may occur between the liner and outer wall in the normal use of the chimney. Such chimneys may have a height of up to approximately 700 feet and, thus, substantial movement may occur as a result of wind forces, etc., acting on the chimney over such a great vertical extent. Illustratively, the chimney may have a movement of one and a half to two feet at its upper end in such a construction.

Because of the differential movement of the liner and outer wall, a seal connected therebetween may have substantial strains induced therein, tending to crack or break the seal. One example of such a seal is illustrated in U.S. Pat. No. 4,191,099 of Victor H. Strahl. In that patent, the seal includes a flexible annular boot. Spring-biased support members are supported on the outer wall of the chimney and connected to an annular seal ring to which a flexible edge portion of the boot is connected to be supported in sealing relation with a lower annular surface of a hood mounted to the liner. The flexible boot and biasing means are relatively expensive and servicing and maintenance thereof at the top of such a 700-foot chimney is relatively difficult.

SUMMARY OF THE INVENTION

The present invention comprehends an improved stressless seal for use in such a chimney application which is extremely simple and economical of construction while yet providing positive, troublefree sealing of the space between the liner and outer wall.

More specifically, the invention comprehends the provision of such a seal wherein a first annular seal slidably engages a second seal having a cylindrical sealing surface concentric to the chimney portion to which the first seal is mounted. The second seal, in turn, is slidably mounted to the other of the chimney elements by a third, sliding seal. The third seal slides on a planar annular surface of a support to accommodate radial movement between the liner and outer wall of the chimney, while the slidable engagement of the first seal with the cylindrical second seal accommodates longitudinal displacement therebetween.

Thus, all relative movement between the liner and outer wall is accommodated by the improved seal of the present invention without the need for flexible boots, resilient biasing means, etc. Resultingly, the improved seal structure of the present invention is extremely low cost and maintenance free, while yet effectively assuring the desired positive seal of the space between the liner and outer chimney wall.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
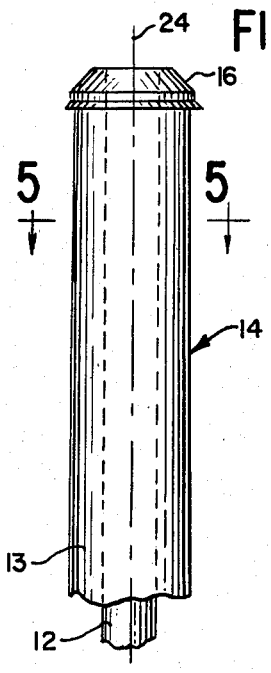
FIG. 1 is a fragmentary elevation of an upper portion of a chimney provided with a sealing means embodying the invention.

In the exemplary embodiment of the invention as shown in FIGS. 1–3, and 5, an improved seal generally designated 10 is provided for sealing the tubular space 11 defined by a tubular inner liner 12 and a tubular outer chimney wall 13 of an industrial-type chimney generally designated 14. In such a chimney, the liner is conventionally formed of suitable bricks 15 which are resistant to the corrosive action of the products of combustion delivered upwardly through the liner in the normal use of the chimney. However, the outer wall 13 is conventionally formed of concrete and is subject to deterioration is subjected to the corrosive products of combustion. Thus, the present invention is concerned with an improved seal 10 which permits the space 11 to be maintained under a positive fluid pressure, thereby assuring the prevention of products of combustion from entering into the space 11 so as to attack the concrete wall 13.

Figure 2:
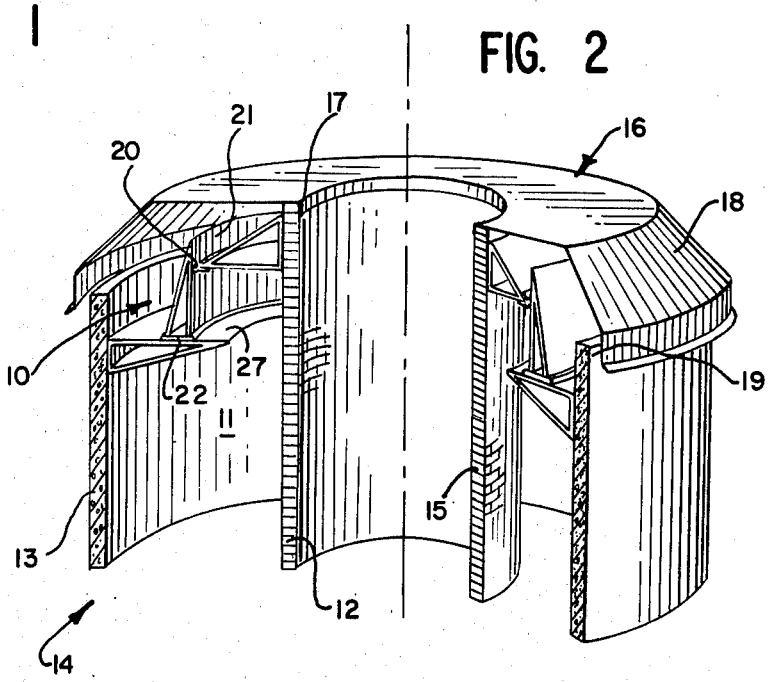
FIG. 2 is a fragmentary vertical section illustrating in greater detail the arrangement of the sealing means of the invention in sealing the upper end of the space between the chimney liner and outer wall.

As illustrated in FIG. 2, the upper end of chimney 14 may be provided with a rain hood 16 extending radially outwardly from the upper end 17 of liner 12. The distal portion 18 of the rain hood extends downwardly to about the upper end 19 of outer chimney wall 13 thus to prevent rain from entering into the space 11 and further deflect the products of combustion away from the space.

In the conventional chimney application, the space 11 is provided with pressurized air which is effectively maintained under pressure by the seal 10 notwithstanding relative movement between liner 12 and outer wall 13. As indicated above, such relative movement may be substantial in a conventional industrial chimney and, thus, substantial movement must be accommodated by the seal 10 in normal use.

Figure 3:
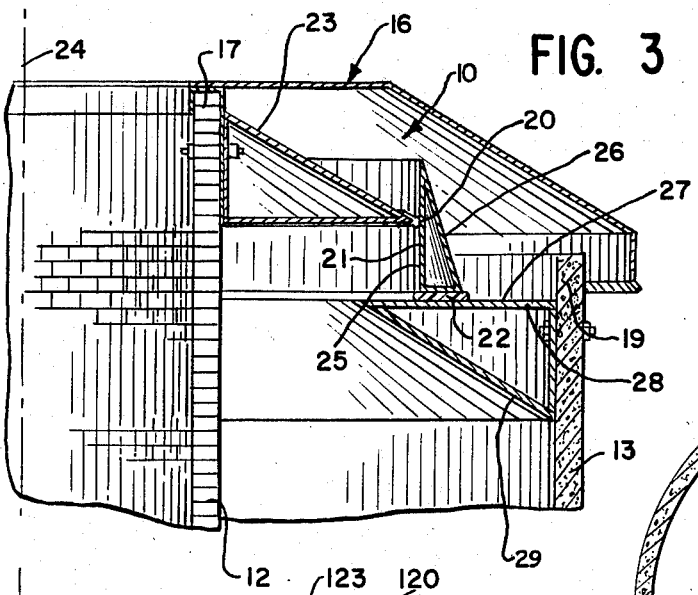
FIG. 3 is a fragmentary enlarged vertical section thereof.

Referring now more specifically to FIG. 3, seal 10 includes a first annular seal element 20, a second cylindrical seal element 21, and a third annular seal element 22. First seal 20 is fixedly carried on the liner 17 by means of a first boxframe support 23 fixedly secured to the upper end 17 of the liner 12. Seal 20 may comprise an annular seal formed of a suitable slidable material, such as Teflon (tetrafluoroethylene polymer) and is mounted to extend annularly concentric to the axis 24 of the chimney.

Seal 21 is defined by a cylindrical surface of a cylindrical wall 25 of a second boxframe support 26 of seal structure 10. The diameter of the inner surface of wall 25 is preselected to provide a sliding, sealed fit of the seal 20 therewith when the support 26 is disposed in encircling relationship to the seal 20, as illustrated in FIG. 3.

As further illustrated in FIG. 3, boxframe support 26 is carried on the slide seal 22 for movement therewith along the slide surface 27 defined by an upper wall 28 of a third boxframe support 29 fixedly mounted to the chimney outer wall 13. Annular seal 22 thus may have sliding movement radially of chimney axis 24 along the surface 27 as a result of radial displacement between liner 12 and chimney outer wall 13. Concurrently, seal 20 may have sliding sealed movement against the support wall 25 as an incident of longitudinal displacement between the liner 12 and chimney outer wall 13, i.e. displacement parallel to the axis 24 of the chimney.

Thus, while the sealing engagement between seal 20 and seal 21, and the sliding engagement between seal 22 and sealing surface 27 may be annularly eccentric relative to the outer wall 13, the sealing engagement is maintained concentric of the axis 24 at all times.

As the seal 10 requires no flexible interconnections between respective portions of the seal, problems relative to failure of such flexible seal elements in such a hostile environment are effectively avoided. Further, as the maintained concentric arrangement of the seal 21 and seal 22 to the axis of the liner 12 is maintained at all times, the need for expensive and maintenance-requiring biasing means is effectively eliminated, providing a further improvement over the prior art structures.

The use of the boxframe support structures effectively provides positive maintained alignment of the seal elements notwithstanding substantial movement between the chimney walls 12 and 13. The weight of the boxframe support 26 is preselected to assure a positive sealed engagement by the seal 22 carrying support 26 with the sealing surface 27.

Figure 5:
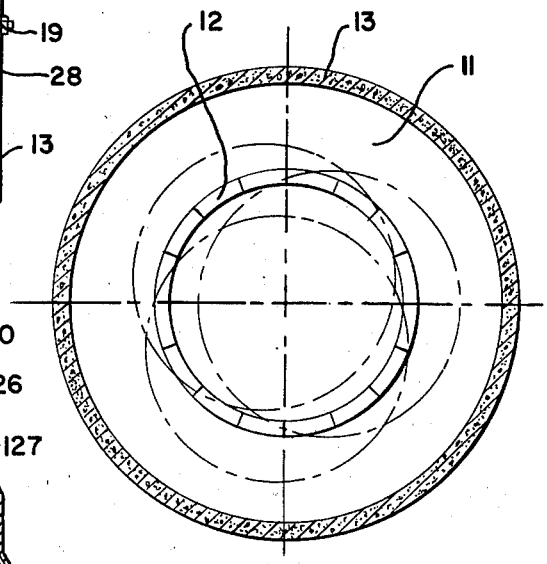
FIG. 5 is a transverse section taken substantially along the line 5—5 of FIG. 1, illustrating different concentric and eccentric dispositions of the liner relative to the chimney outer wall to be accommodated by the sealing means of the invention.

The substantial displacement of liner 12 relative to outer chimney wall 13 is illustrated in FIG. 5 wherein the normal concentric arrangement is shown in full lines. As shown in broken lines, however, therein, the liner may move in any direction radially relative to the outer wall 13. Such movement is accommodated by the improved seal 10 without introduction of stresses and strains so as to assure long, troublefree life of the seal notwithstanding such adverse conditions.

In the illustrated embodiment of FIG. 3, seal 20 is carried on the liner 12 and seal 21 is movably carried on the outer wall 13 of the chimney. As will be obvious to those skilled in the art, a reverse arrangement may be provided functioning identically in all other respects. Thus, in broadest aspect, the seal 20 may be mounted fixedly to either chimney wall 12 or chimney wall 13 and seal 21 movably mounted to the other of chimney 12 and chimney wall 13 within the scope of the invention.

Figure 6:
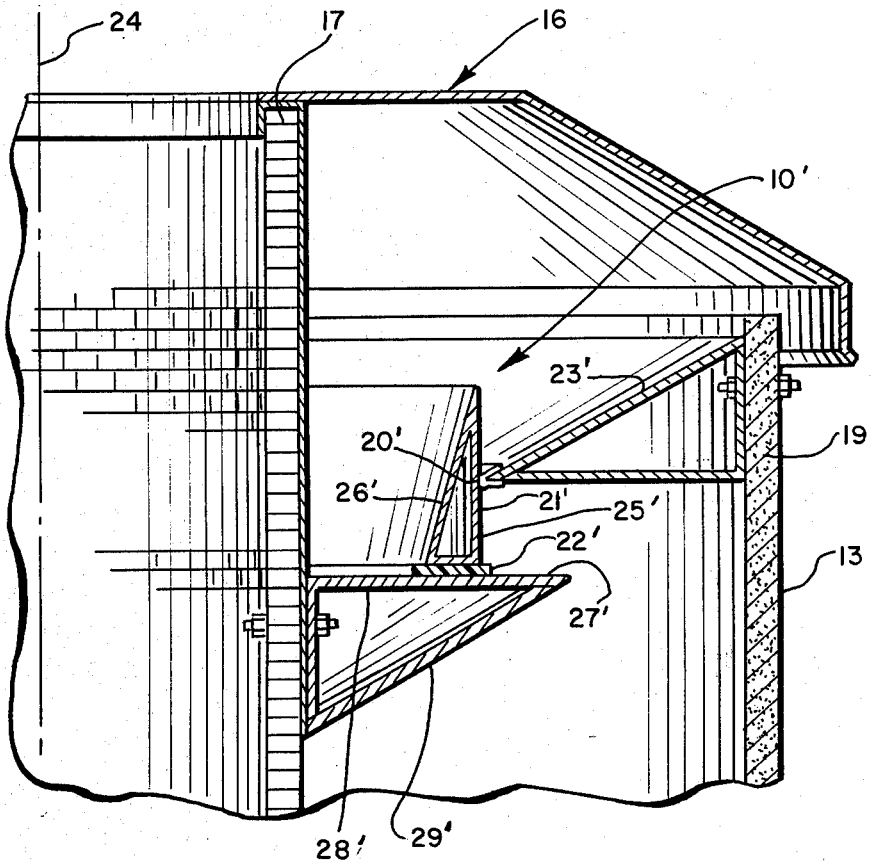
FIG. 6 is a fragmentary enlarged vertical section similar to that of FIG. 3, but illustrating the reverse arrangement of the sealing means.

More specifically, as seen in FIG. 6, the seal 20′ is mounted fixedly to the chimney wall 13 and the seal 21′ is movably mounted to the chimney wall 12. Elements of seal 10′ corresponding to elements of seal 10 illustrated in FIG. 3, are identified by similar reference numerals but primed. Other than being a reverse arrangement of the seal 10 of FIG. 3, seal 10′ of FIG. 6 is similar thereto and functions in a similar manner.

Figure 4:
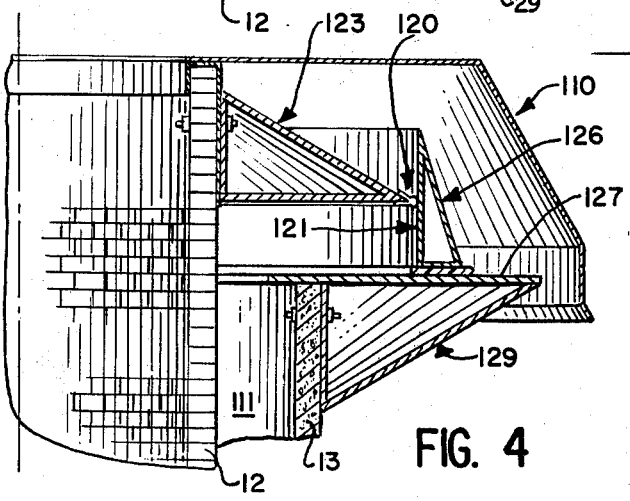
FIG. 4 is a fragmentary enlarged vertical section illustrating a modified form of sealing means embodying the invention.

Still further, a further modified form of seal embodying the invention generally designated 110 is illustrated in FIG. 4. Thus, as shown in FIG. 4, the support 129 defining the slide surface 127 extends radially outwardly from the outer chimney wall 13 rather than radially inwardly as in seal structure 10. The arrangement of FIG. 4 has the substantial advantage of permitting outer chimney wall 13 to have a reduced diameter so as to reduce the radial dimension of the annular space 111 between liner 12 and outer wall 13, thereby minimizing the volume of the pressurized air in space 111.

In all other respects, the seal 110 is similar to seal 10 and functions in a similar manner.

Seal 22 may be formed of any suitable slidable sealing material, and in the illustrated embodiment, is formed of Teflon. In addition to having low friction, Teflon is an advantageous candidate for such seal structure in further being relatively corrosion-resistant.

The seal 20 may be secured to support 23 by any suitable means and similarly, the securing of support 26 to the seal 22 may be effected by any suitable means as desired.

As will be further obvious to those skilled in the art, a plurality of seals 10 may be employed in vertically spaced relationship if desired to provide further positive sealing of the space 11, such as where relatively high air pressures are utilized.

The foregoing disclosure of specific embodiments is illustrative of the broad inventive concepts comprehended by the invention.

I claim:

1. In a chimney structure having a radially inner tubular liner and a radially outer tubular wall defining a tubular space therebetween wherein a pressurized fluid is provided to prevent flow of gaseous products of combustion from within said liner into said space, improved means for sealing an upper end portion of the liner to an upper end portion of the outer wall to retain the pressurized fluid in said space, said improved sealing means comprising:

a first, annular seal;

means for sealingly mounting said seal to one of said liner or outer wall at the upper end portion thereof;

a movable seal support defining a cylindrical sealing surface; and means for sealing said seal support to the other of said liner or outer wall including cooperating radially sliding seal means including a second, annular seal, permitting sealed radial movement of said second seal toward and from said other of the liner or outer wall to which it is mounted, said seal support sealing surface having longitudinally slidable sealed engagement with said first seal permitting longitudinal movement between said liner and outer wall while maintaining sealed engagement of said second seal with said first seal.

2. The chimney structure of claim 1 wherein said first seal is mounted to said liner.

3. The chimney structure of claim 1 wherein said first and second seals are disposed at the upper end of said space intermediate said liner and outer wall.

4. The chimney structure of claim 1 wherein said first and second seals are disposed radially outwardly and above the upper end of said outer wall.

5. The chimney structure of claim 1 wherein said first and second seals are retained substantially in coaxial relationship to said one of the liner and outer wall at all times.

6. The chimney structure of claim 1 wherein said first and second seals are retained substantially in coaxial relationship to said one of the liner and outer wall at all times while being permitted to be in in eccentric relationship to the other of said liner and outer wall as an incident of noncoaxial disposition of the liner and outer wall.

7. In a chimney structure having a radially inner tubular liner and a radially outer tubular wall defining a tubular space therebetween wherein a pressurized fluid is provided to prevent flow of gaseous products of combustion from within said liner into said space, improved means for sealing an upper end portion of the liner to an upper end portion of the outer wall to retain the pressurized fluid in said space, said improved sealing means comprising:

a first, annular seal;

a first support fixedly sealingly mounting said seal to one of said liner or outer wall at the upper end portion thereof;

a second support defining a cylindrical sealing surface;

a second, annular seal; and a third support for slidably carrying said second seal on the other of said liner or outer wall permitting sealed radial sliding movement of said second seal toward and from said other of the liner or outer wall, said second seal being mounted to said second support for radial movement with said second support, said second support sealing surface having longitudinally slidable sealed engagement with said first seal, permitting longitudinal movement between said liner and outer wall while maintaining sealed engagement of said seals with said supports.

8. The chimney structure of claim 7 wherein said third support defines a planar annular slide surface on which said second seal slides.

9. The chimney structure of claim 7 wherein said third support defines a planar annular slide surface on which said second seal slidingly rests.

10. The chimney structure of claim 7 wherein each of said first and third supports comprise a boxframe structure fixedly secured to the respective liner and outer wall to which it is mounted.

11. The chimney structure of claim 7 wherein said third support defines a planar annular slide surface on which said second seal slides, said slide surface extending radially inwardly from said outer wall.

12. The chimney structure of claim 7 wherein said third support defines a planar annular slide surface on which said second seal slides, said slide surface extending radially outwardly from said outer wall.

13. The chimney structure of claim 7 wherein said cylindrical surface comprises a radially inner cylindrical wall portion of said second support.

14. The chimney structure of claim 7 further including an annular rain hood spaced above the upper end of said sealed space and defining an end space opening to outwardly of said outer wall.

15. The chimney structure of claim 7 further including an annular rain hood extending radially outwardly from the upper end of said liner and being spaced above the upper end of said sealed space and defining an end space opening to outwardly of said outer wall.

* * * * *